US005890328A

United States Patent [19]

Gleave

[11] Patent Number: 5,890,328

[45] Date of Patent: Apr. 6, 1999

[54] ROOF EAVE VENTILATION SAFETY DEVICE

[76] Inventor: David Gleave, 36 Colquhoun Drive, Bearsden, Glasgow, United Kingdom, G61 4NQ

[21] Appl. No.: 679,614

[22] Filed: Jul. 10, 1996

Related U.S. Application Data

[62] Division of Ser. No. 85,899, Jun. 30, 1993, Pat. No. 5,581, 955.

[30] Foreign Application Priority Data

Jul. 2, 1992 [GB] United Kingdom ..... 9214128
Aug. 26, 1992 [GB] United Kingdom ..... 9218128

[51] Int. Cl.[6] ..... E04B 7/02; E04G 3/14

[52] U.S. Cl. ..... 52/94; 52/27; 52/90.1; 52/91.2; 52/96

[58] Field of Search ..... 52/27, 94–97, 52/710, 91.2, 90.1, 90.3; 248/237, 228.1; 182/3, 36, 37, 8

[56] References Cited

U.S. PATENT DOCUMENTS

| | | | |
|---|---|---|---|
| 1,176,652 | 3/1916 | Clark | 182/38 X |
| 1,470,388 | 10/1923 | Pitou | 182/37 |
| 3,420,546 | 1/1969 | Jasovsky | 248/51 X |
| 3,696,572 | 10/1972 | Jureit | 52/94 |
| 3,860,089 | 1/1975 | Huggett | 182/4 |
| 4,461,128 | 7/1984 | Knoebl | 52/94 |

FOREIGN PATENT DOCUMENTS

| | | | |
|---|---|---|---|
| 2558873 | 8/1985 | France . | |
| 3728282 | 3/1988 | Germany . | |
| 1 571 385 | 7/1980 | United Kingdom . | |
| 2140841 | 12/1984 | United Kingdom . | |
| 2244305 | 11/1991 | United Kingdom | 52/127.1 |

*Primary Examiner*—Carl D. Friedman
*Assistant Examiner*—Winnie S. Yip
*Attorney, Agent, or Firm*—Ratner & Prestia

[57] ABSTRACT

A safety device in the form of a building component (3) which has a channel (1) along which a traveller (4) may move. The traveller (4) has attachment means (5) for attachment to a safety harness. The building component (3) can be in the form of a roof ridge section (6) and can have an internal or external channel along which a suitable traveller (3) can move. The building component (3) can also be in the form of a gutter section (7), roof tile (9) or other component.

6 Claims, 14 Drawing Sheets

ROOF EAVE VENTILATION SAFETY DEVICE

This application is a division of application Ser. No. 08/085,899, filed Jun. 30, 1993, now U.S. Pat. No. 5,581, 955.

This invention relates to a safety device for ensuring the safety of any person requiring access to a roof area of a building whether during building, maintenance works, inspection, or cleaning.

BACKGROUND OF THE INVENTION

In the past operative access to roof areas has been a major source of danger during inspection and maintenance procedures on sloping roofs leading to falls from roofs and buildings. Such accidents are a major source of injury and fatalities in the building industry.

Currently, for major works, the normal arrangement is the provision of a scaffolding system erected on the building face, the scaffolding being solidly lined and fitted with hand rails at the roof edge. The economics of small tasks and inspections does not permit this method to be adopted. Also, gaps within hand rails or scaffolding permit operators to fall over or through a roof or balcony edge.

Fixed vertical ladders which provide access to roof and roof mounted equipment, for example extract fans, are often fitted with hoops to provide some protection in the event of slipping; however, the gaps are so large that it is possible to fall through such hoops and to sustain injury.

Elevating platforms and wall maintenance cradles are also known and are subject to occasional mechanical failure. If a sudden tilt of a platform or cradle occurs, the operatives risk being thrown out of the cradle or platform.

Currently designers sometimes specify eye bolts at intervals across a roof and trade practice generally uses roof ladders in the form of traditional ladders with hooks that pass over the ridge on to the opposing incline.

This has the disadvantage that there is no means of safely transferring from one eye bolt to another without first unhooking the harness.

Prior art has addressed the problem of safety when working in a position vertically removed from the ground. GB1571385 discloses a rail tether system for use on a sloping surface in this case a large sewerage tank wherein a traveller, to which a harness is attached, travels within a rail attached to the top of the tank. GB1478585 and U.S. Pat. No. 3,860,089 both disclose slotted hollow rails built into balconies to prevent window cleaners from falling. These systems require a separate rail component to be attached to a building.

It is an object of the present invention to provide a safety device incorporated in a building component enabling high safety standards to be maintained whilst providing access to a roof area or to the top of a building.

SUMMARY OF THE INVENTION

According to a first aspect of the present invention there is provided a safety device comprising a track being integral to a building component, and a traveller slidably attachable to the track and having an attachment means to a safety harness.

The traveller may be slidably attached within the track; alternatively, the traveller may fit externally around the track, for sliding movement along the track.

More than one traveller may be slidably attachable to the track.

The building component may be in the form of a roof ridge; alternatively, it may be in the form of the following: a gutter system, roof tile, a soffit undereaves, or building block.

The building component may be in the form of a roof ridge section having a channel along which the traveller may move, said channel being disposed on the apex of the roof ridge. Alternatively, the channel may be disposed at a lower end of the roof ridge section.

Preferably, a plurality of sections may be placed together in use to provide a continous channel along which the traveller may move.

The roof ridge section may be formed of two hingeable components which allow for accommodation of a variety of roof pitches.

According to a second aspect of the present invention there is provided a safety device comprising a track in the form of a housing having a continuous longitudinal opening, and a traveller longitudinally slidable within the housing and having an arm extending through the opening for attachment to a safety harness, the remainder of the traveller being trapped within the housing.

Preferably, the traveller comprises at least one wheel disposed within the track.

Preferably, the or each wheel is disposed such that its rotational axis is perpendicular to the longitudinal axis of the track.

Preferably, the wheel is tapered towards its periphery and the housing is not tapered, to allow the traveller device to negotiate angles in the track.

Preferably, the surface of the housing and the surfaces of the wheel are of low friction material in order to avoid jamming of the wheel.

Preferably, the traveller has a locking means which prevents movement of the traveller when subjected to a sudden load.

Preferably, the housing has a sleeve lining at an end portion of the track to prevent unintentional movement of the traveller when it is in this portion of the track.

The track may be heated to prevent ice forming in the housing.

Preferably, the heating means is in the form of an oil reservoir below the track through which a current is passed.

The track may have by-pass portions comprising parallel portions of track which interconnect to enable a first traveller device to pass a second traveller device.

The opening in the track may have a plurality of one-way access means which allow the guide to pass in one direction but require manual operation to allow the guide to return in the opposite direction. This may be of particular use if the rail is angled or substantially vertical.

Preferably, the track is located to allow maximum access to a risk area.

The risk area may be a boat deck or roof or other raised area and the safety harness may be of a length equal to or less than the distance of the track from the edge of the risk area so as to prevent the person from falling from the risk area.

Preferably, the track is incorporated in a hand-rail. Alternatively, the track may be formed as part of a roof-ridge or other building component.

Preferably, the track has a lockable removable end to prevent the travellers from leaving the track when in use, but also to enable the travellers to be removed for maintenance requirements.

BRIEF DESCRIPTION OF THE DRAWINGS

Embodiments of the present inventions will now be described by way of example, only with reference to the accompanying drawings in which.

DESCRIPTION OF PREFERRED EMBODIMENTS

Figure 1A:
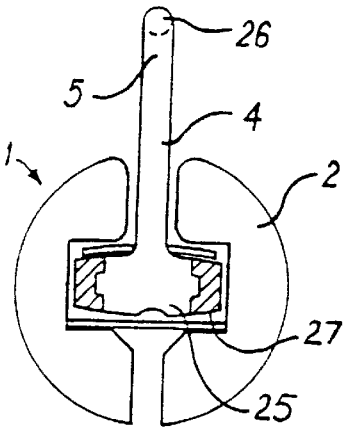
FIG. 1*a* is an end view of a traveller for use with an internal channel in accordance with the present invention.
Figure 1B:
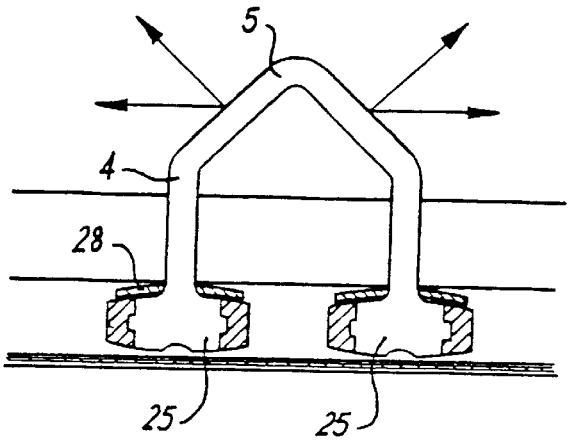
FIG. 1*b* is a section through the traveller of FIG. 1*a;*
Figure 1C:
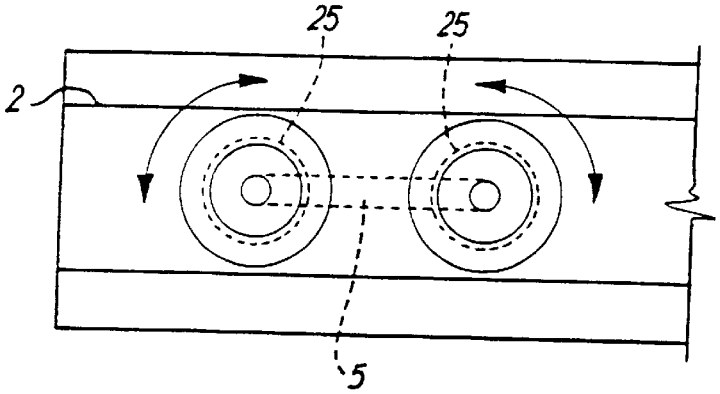
FIG. 1*c* is a top view of the traveller of FIG. 1*a;*
Figure 1D:
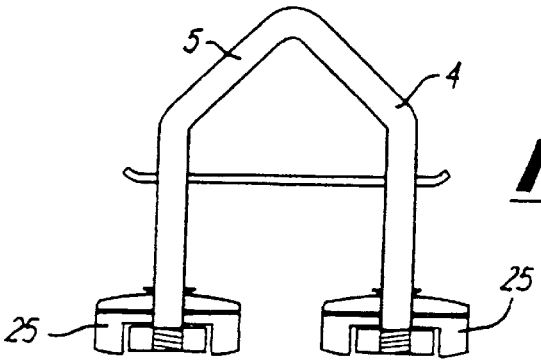
FIG. 1*d* is a side view of a second traveller in accordance with the present invention.
Figure 2:
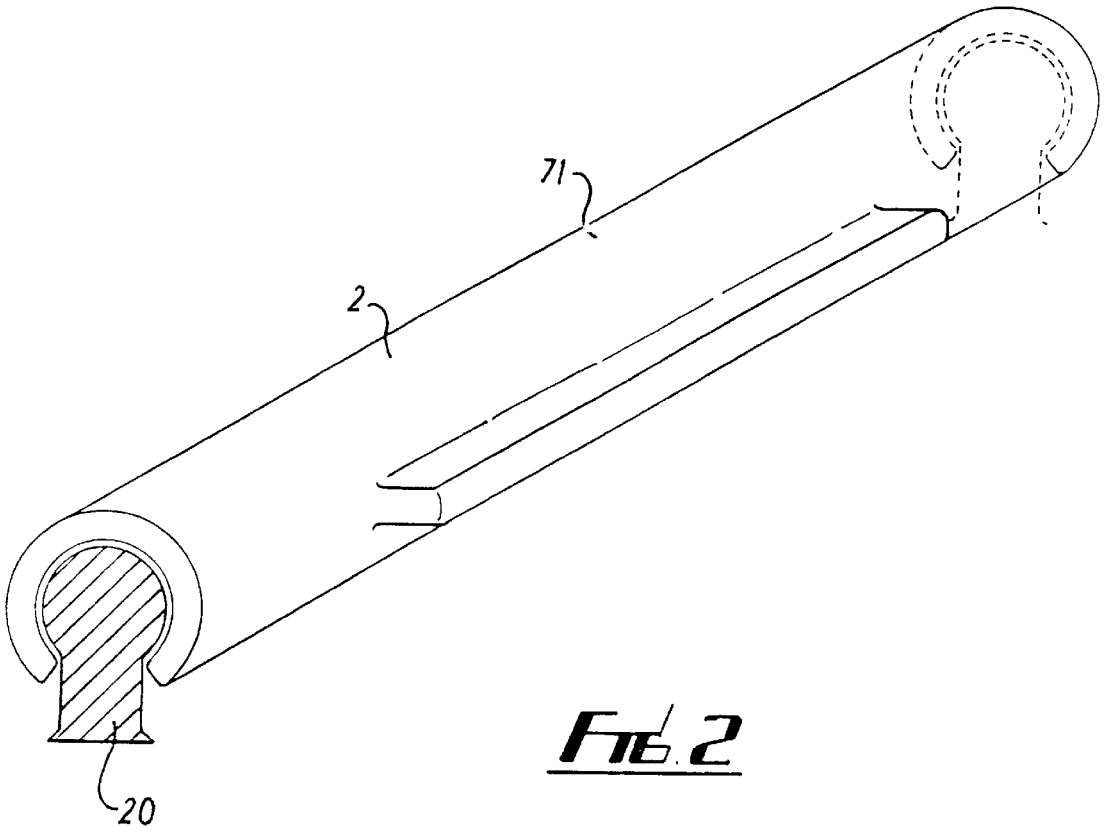
FIG. 2 is a traveller for use with an external channel in accordance with the present invention.

Referring to the drawings, a safety device 1 has a track or channel integral to a building component 3 and a traveller 4 which is slidable along the channel 2. The traveller 4 has attachment means 5 for attachment to a safety harness.

Figure 12A:
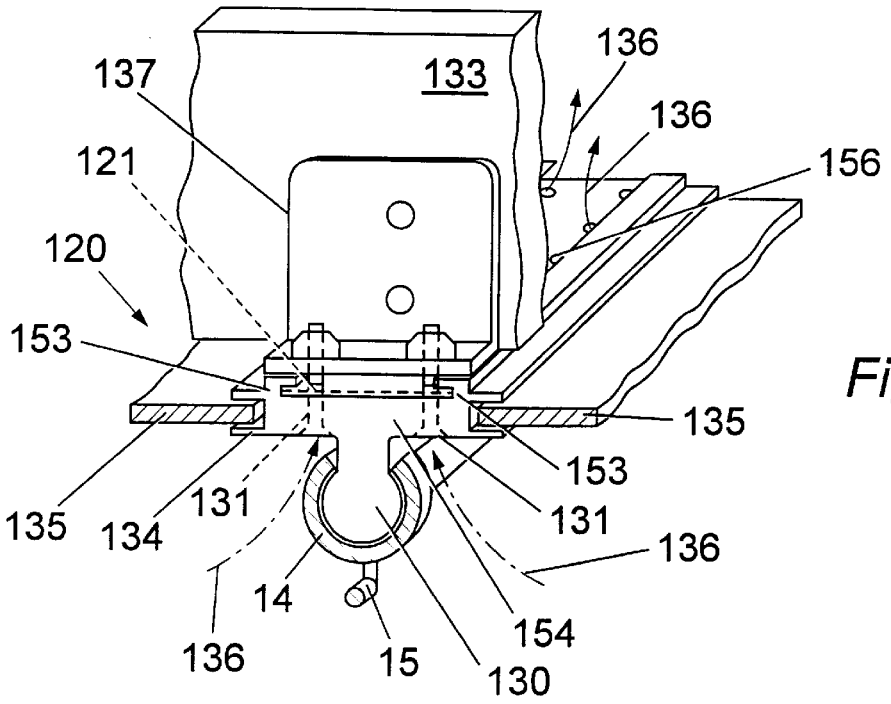
FIGS. 12*a* and *b* are under eaves slots in accordance with the present invention.
Figure 12B:
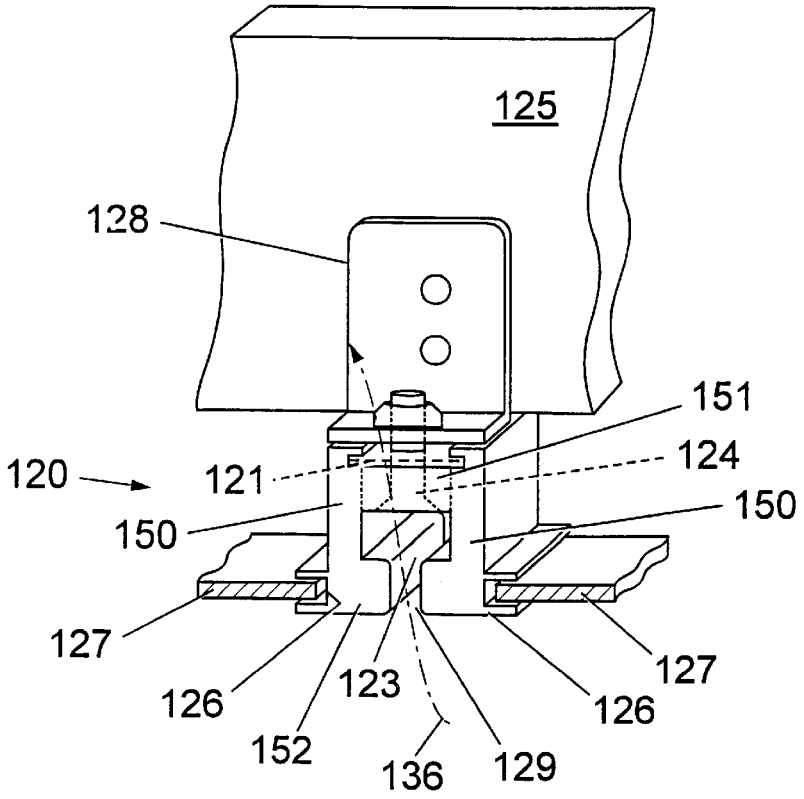
Figure 13A:
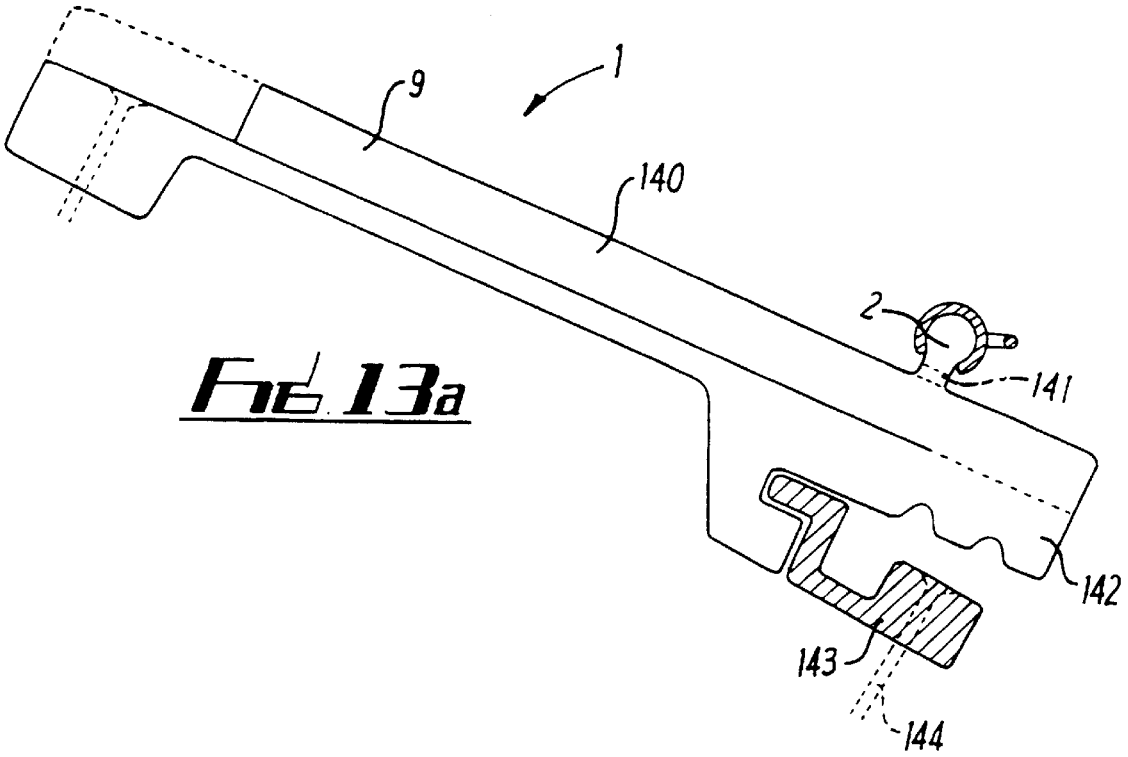
FIGS. 13*a* and *b* are safety devices in accordance with the present invention in the form of roof tiles.
Figure 13B:
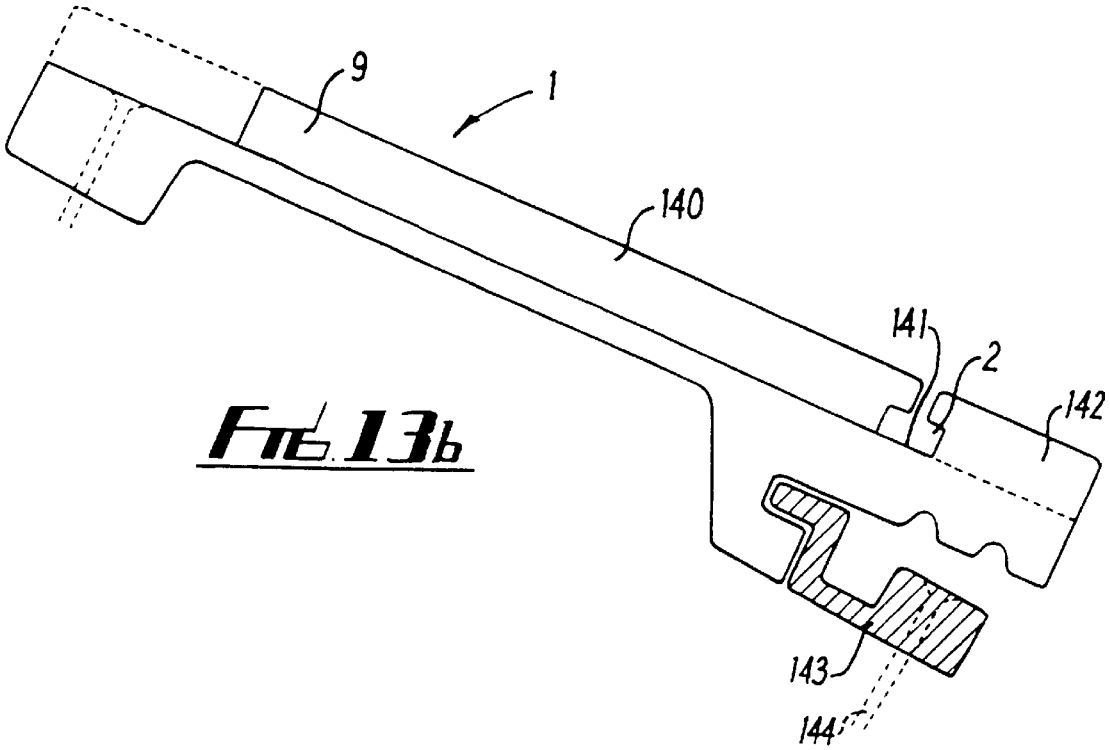
Figure 14:
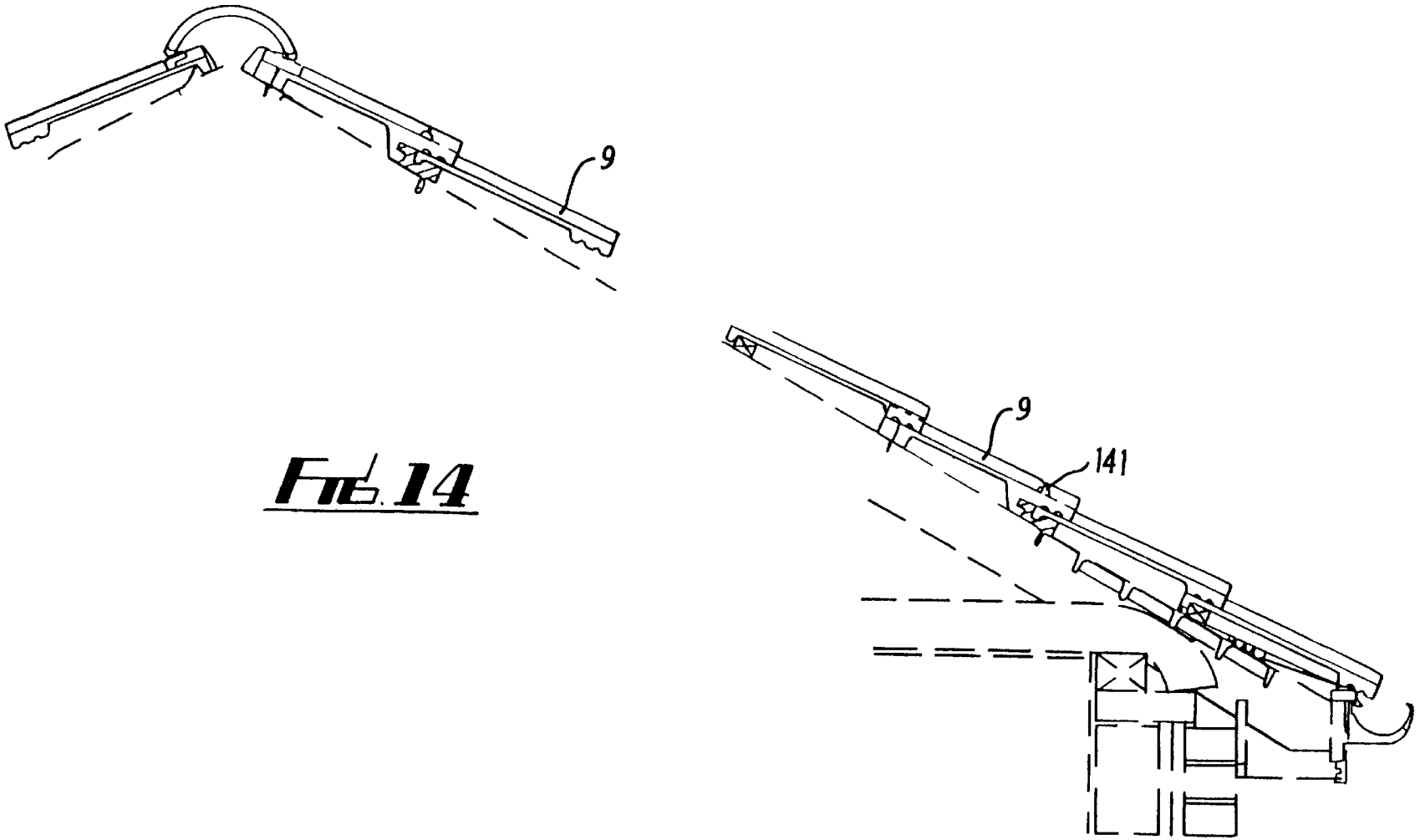
FIG. 14 is an arrangement of roof tiles of FIG. 13*a* and 13*b*.

The building component 3 may be in the form of a roof ridge section 6 (FIGS. 3, 4, 5, 6, 7, 8, 9 and 10), a gutter section 7 (FIG. 11), the eaves of a building 8 (FIG. 12), or a sloping roof tile 9 (FIGS. 13 and 14).

Figure 3:
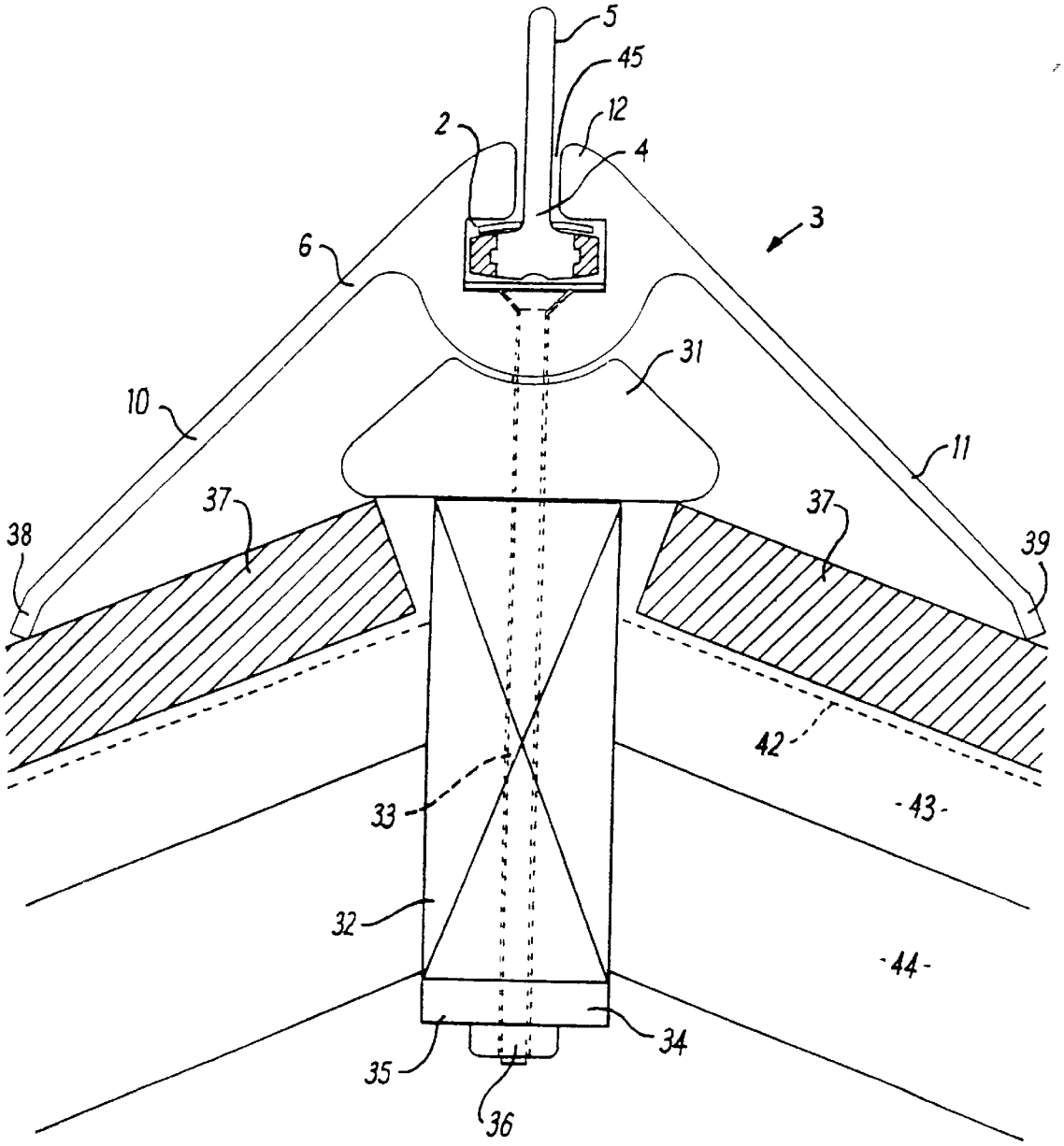
FIG. 3 is a roof ridge in accordance with the present invention.

In the embodiment in which the building component 3 is in the form of a roof ridge section 6, (different arrangements are illustrated in FIGS. 3 to 10) the safety device is in the form of a typical extruded ridge cap which has two angled sides 10, 11 which are joined at an apex 12 at the ridge of a roof. A standard roof ridge provides a weatherproof join at the ridge of a roof. FIG. 3 shows a typical extruded ridge cap 30 with a channel 2 situated at the apex 12 of the ridge cap 30. The channel 2 houses an internal traveller 4. The rounded surround to the channel 2 is mounted on an extruded plastic mounting block 31 disposed between the ridge cap 30 and the ridge rafter 32. Its fixing bolt 33 secures the ridge cap 30 by bolting between the inside of the channel 2 through the mounting block 31 and ridge rafter 32. At the inside lower surface 34 of the ridge rafter 32 a washer plate 35 is disposed around the bolt 33 and a nut fastening 36 is tightened onto the washer plate 35. The mounting block 31 nests on the ridge rafter 32 and on the slates or tiles 37 at either side of the ridge rafter 32. The ends 33, 39 of the sloping sides 10, 11 of the ridge cap 30 nest on the slates or tiles 37 adjacent to the ridge rafter 32. The roof slates or tiles 37 nest on felt 42 and boarding 45 which is supported by the roof rafters 44.

The internal channel 2 has a longitudinal opening 45 at the top of the ridge through which the traveller attachment means 5 passes enabling the traveller 4 to be pulled freely along the inside of the channel 2.

Figure 4A:
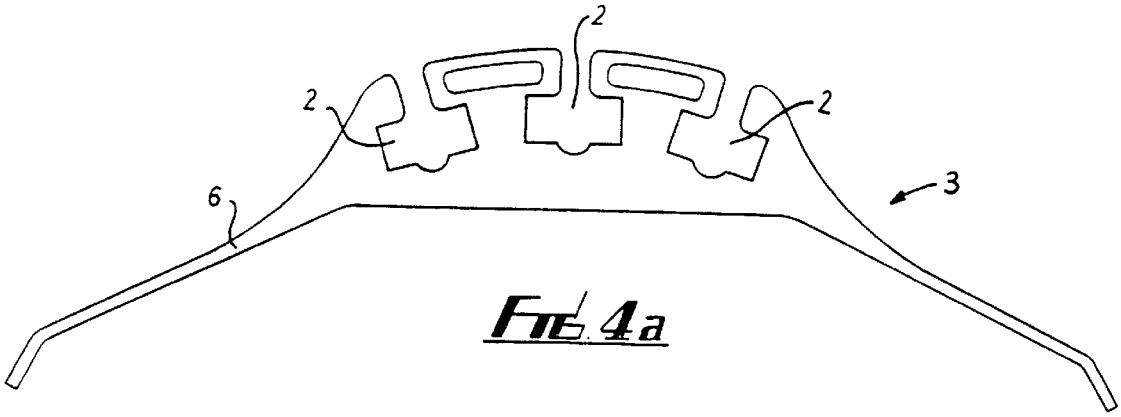
FIG. 4*a* is a roof ridge of FIG. 3 with three internal channels.
Figure 4B:
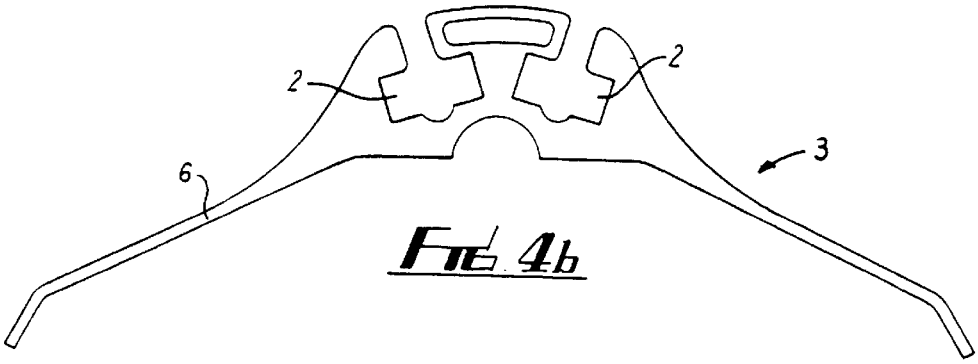
FIG. 4*b* is a roof ridge of FIG. 3 with two internal channels.
Figure 4C:
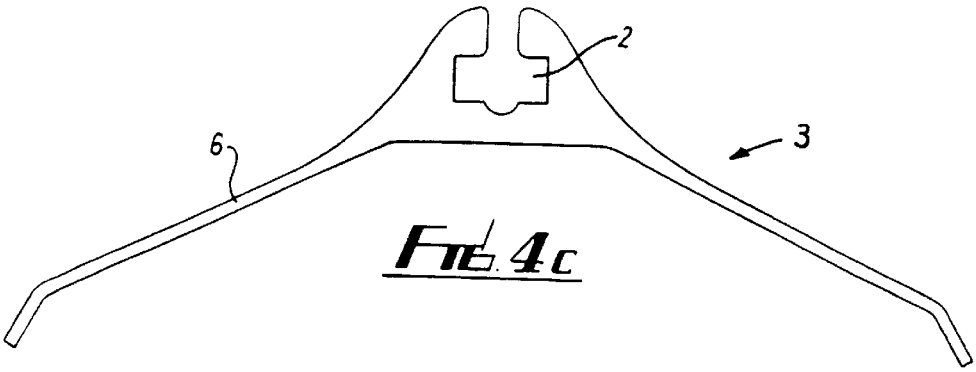
FIG. 4*c* is a roof ridge of FIG. 3 with a single internal channel.

FIGS. 4*a* to 4*c* shows three arrangements of a roof ridge 6 with an internal channel 2. FIG. 4*a* has three channels providing separate channels 2 for three safety harnesses.

Figure 5A:
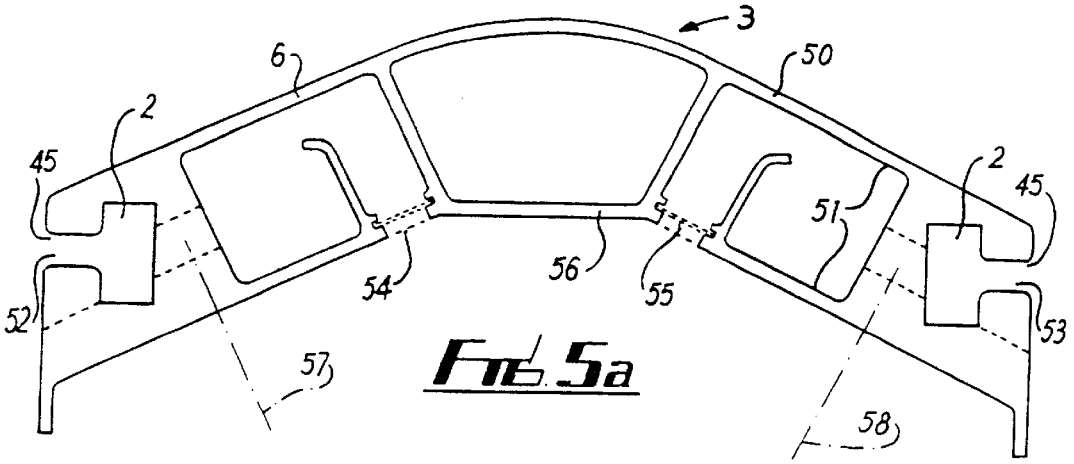
FIG. 5*a* is a box ridge in accordance with the present invention.

FIG. 5*a* illustrates a box ridge 50 for locations of extreme exposure. This ridge 50 is of a doubled layered structure 51 and has two internal channels 2 disposed at each lower side 52, 53 of the roof ridge 50. The box ridge 50 also has vent slots 54 at intervals with an insect mesh 55 on the underside 56 of the roof ridge. Two fixing studs 57, 58 hold the roof ridge 50 onto the roof and are disposed adjacent to the internal channels 2. Each channel 2 has an opening 45 facing towards the side of the roof through which the traveller attachment means 5 may pass.

Figure 5B:
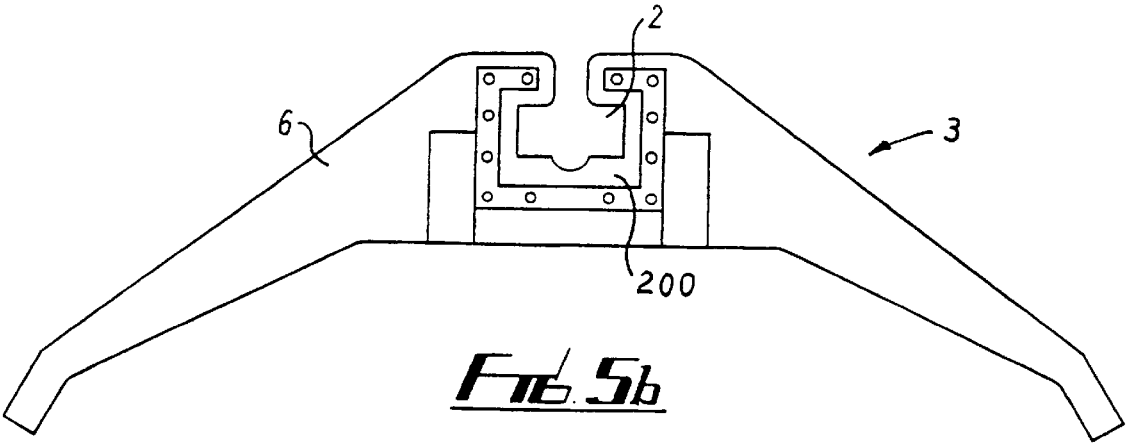
FIG. 5*b* is a reinforced roof ridge in accordance with the present invention.

FIG. 5*b* illustrates a roof ridge 6 having a single internal channel 2, the roof ridge 6 is formed from clay, glass fibre reinforced cement or glassfibre epoxy composite construction containing stainless steel reinforcing cradle and welded stainless steel studs for holding down bolts. FIG. 5*b* shows the positioning of the oil reservoir providing heating means 200.

Figure 5C:
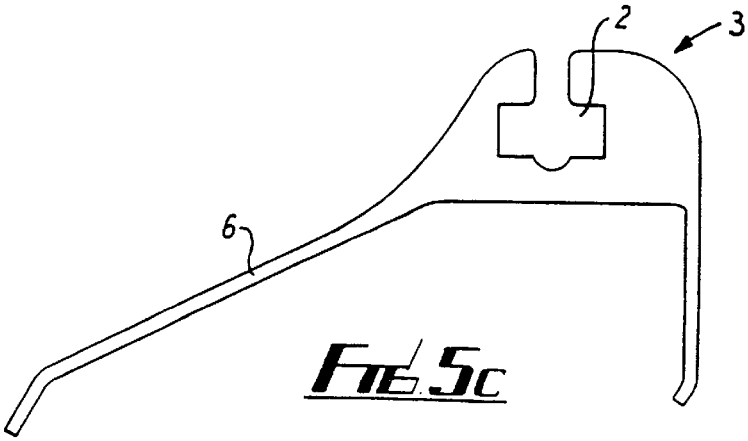
FIG. 5*c* is a mono-ridge in accordance with the present invention.
Figure 6C:
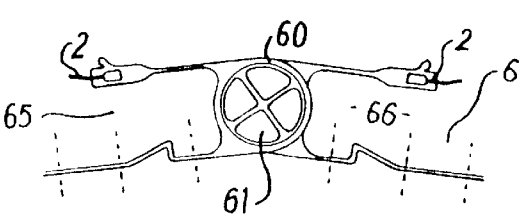
FIGS. 6*a* to *e* is a hinged under-connector for a roof ridge in accordance with the present invention.
Figure 6D:
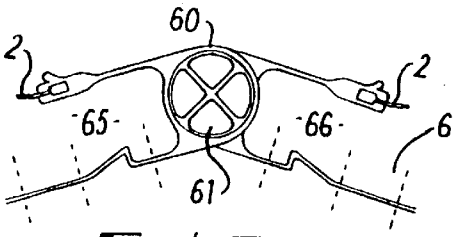
Figure 6E:
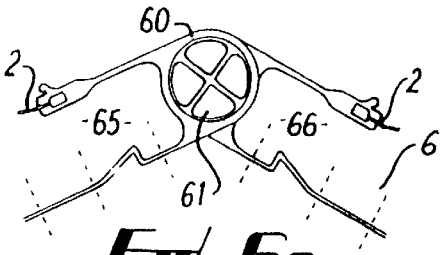
Figure 6A:
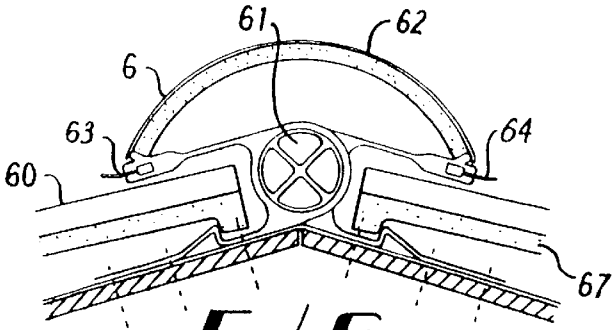
Figure 6B:
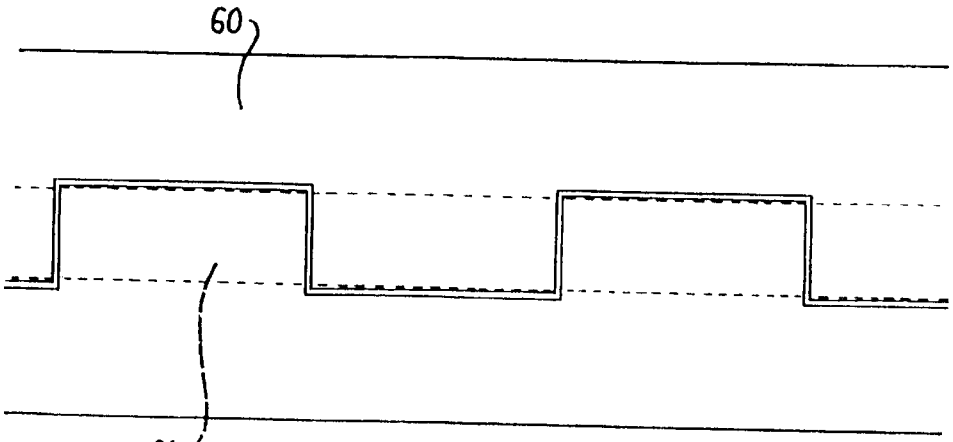

FIG. 5*c* illustrates a mono-ridge for use on a single sided sloping roof.

A roof ridge may suit a variety of pitches of roof by means of a hinged under-connector 60 for a roof ridge (FIGS. 6*a* to *e*). Adjacent sections of the under-connector are alternatively disposed around a pivot tube 61, the pivot tube 61 being at the ridge of the roof. A curved ridge piece 62 is located over the hingeable under-connector 60 ensuring that the roof ridge is waterproof. There are two internal channels 2 disposed at either lower edge 63, 64 of the under-connector 60. The two hingeable portions 65, 66 of the under-connector 60 are hollow allowing the top roof tile 67 to be inserted into the portions 65, 66. The tiles 67 may lock into the portions 65, 66. The hinged under-connector 60 can vary in pitch from approximately 7° to 27° approximately in single degree steps.

Travellers 4 suitable to travelling within an internal channel 2 in a roof ridge 6 or other building component are illustrated in FIG. 1. The traveller 4 has two wheels 25 disposed laterally to the axis 26 of the attachment means 5 of the traveller 4. The wheels 25 are slightly tapered 27 to enable ease of running within the channel 2. The wheels 25 are made of a nylon material and have a teflon washer 28 to provide a smooth running of the wheels 25. FIG. 1*d* shows a traveller 4 which is for use where changes in direction and/or inclination are required.

Figure 7:
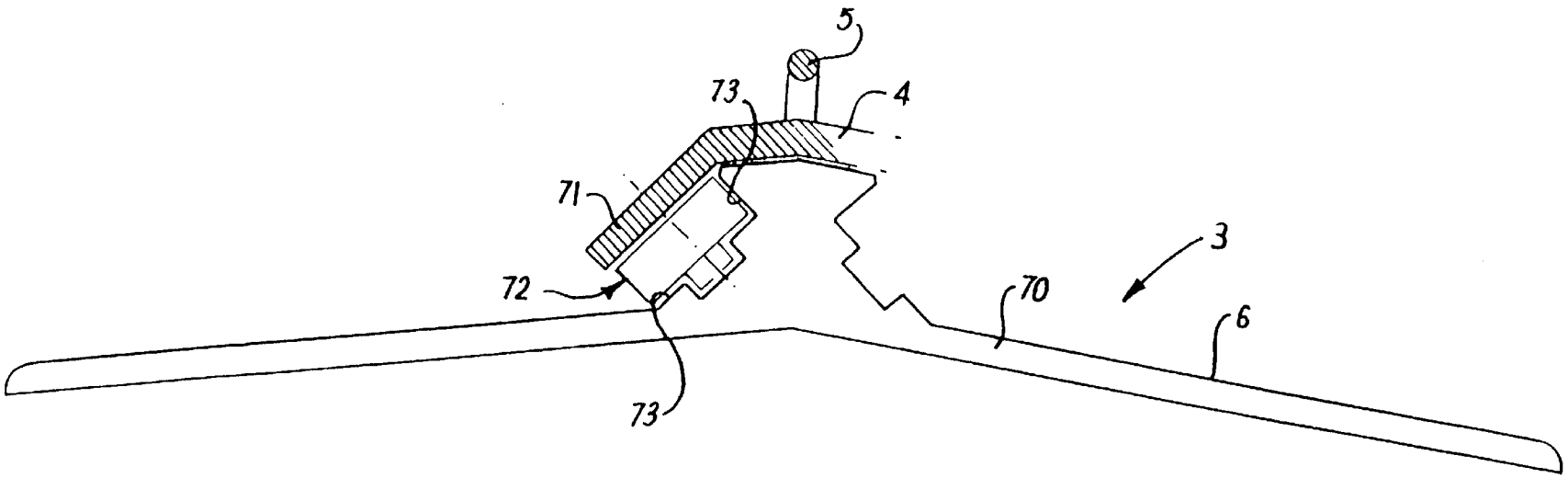
FIG. 7 is a roof ridge with an external channel in accordance with the present invention.
Figure 8A:
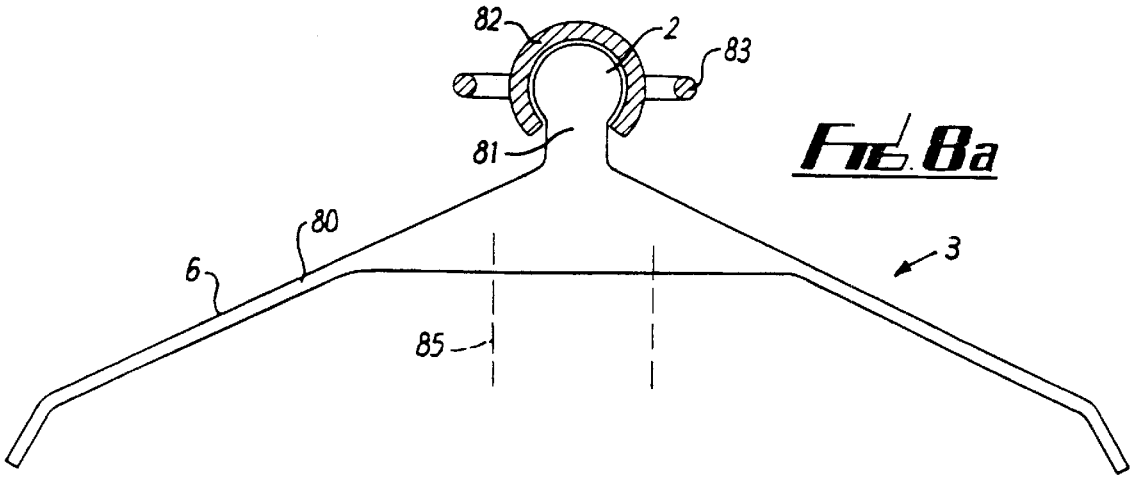
FIGS. 8*a* to 8*c* are three arrangements of roof ridges with external channels in accordance with the present invention.
Figure 8B:
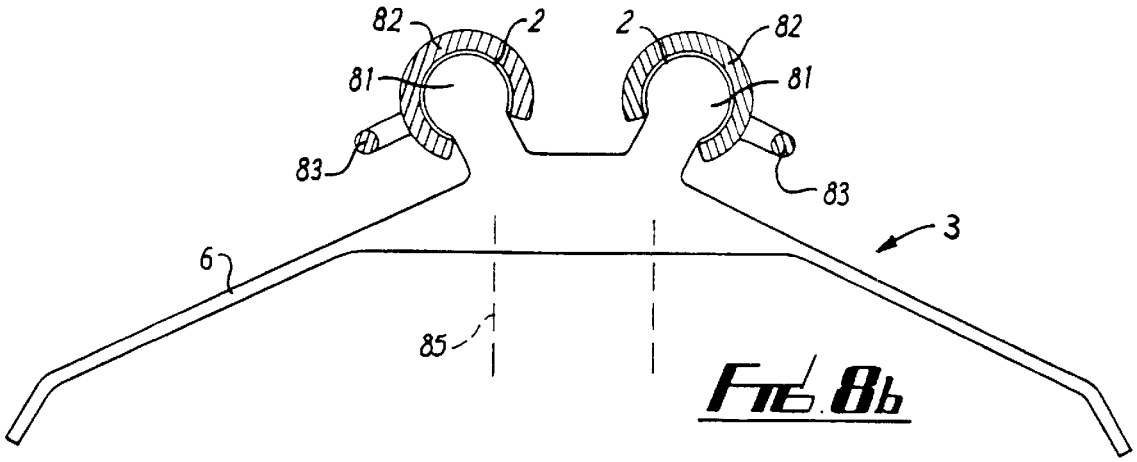
Figure 8C:
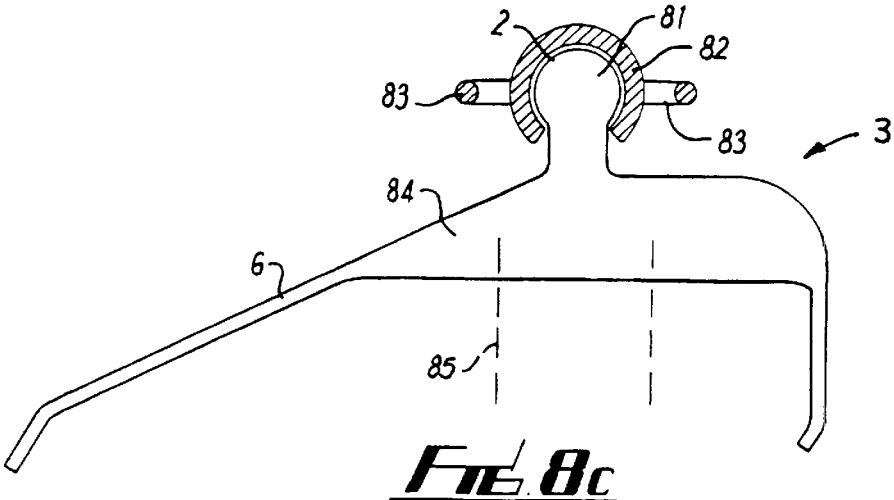

Referring to FIGS. 7 and 8*a, b* and *c*, a roof ridge may have an external channel arrangement 20 around which a traveller 71 is slidable. FIG. 7 illustrates a ridge 70 suitable for use on low pitched roofs for example, approximately 8°. The traveller 71 has 4 or 6 wheels 72 and the wheels 72 are angled to run along faces 73 of the channel 20. The number of wheels 72 of the travellers 71 will depend on the loadings required. FIGS. 8*a* to *c* illustrates a ridge cap 80 with a bulb channel 81 around which a traveller 82 in the form of a part circle of stainless steel is disposed. Loops 83 are welded to the traveller 82 for attachment to a safety harness. FIG. 8*b* shows a double channelled roof ridge and FIG. 8*c* shows a roof ridge 84 suitable for a single sided sloping roof.

Figure 9:
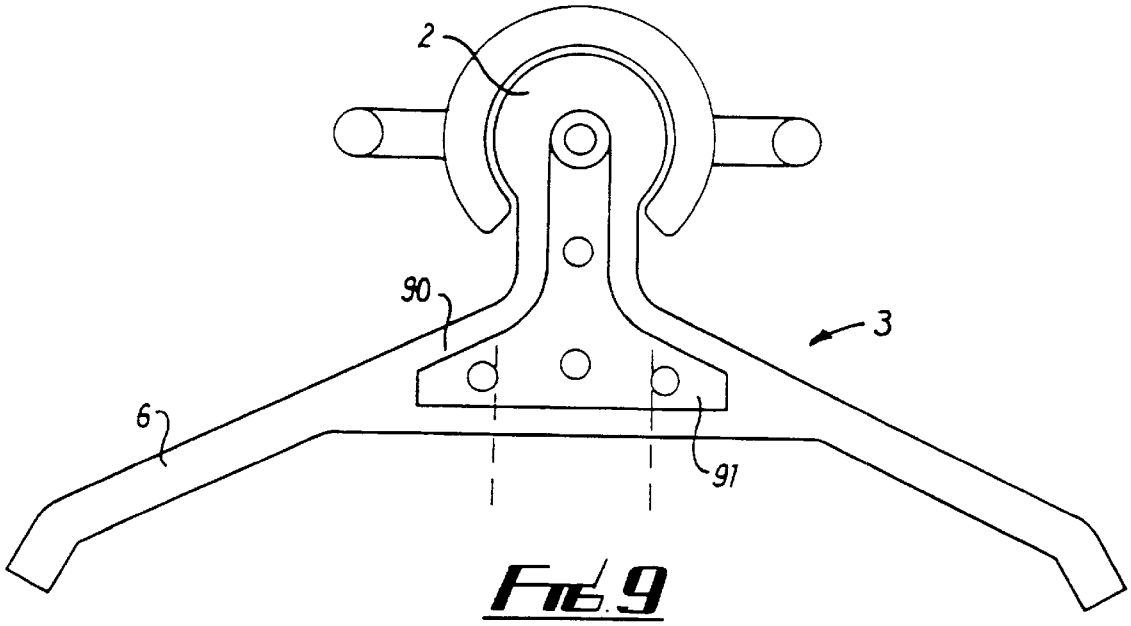
FIG. 9 is a reinforced ridge with an external channel in accordance with the present invention.
Figure 10:
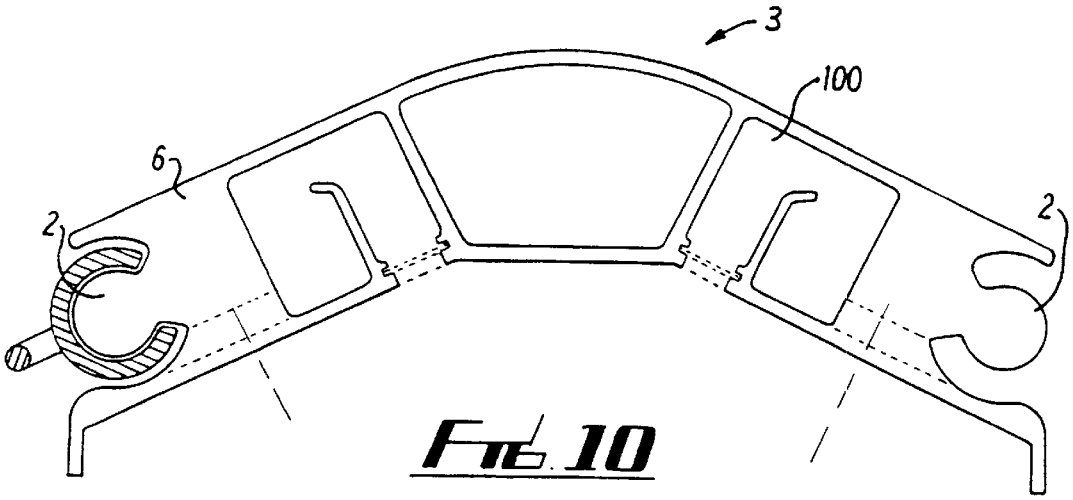
FIG. 10 is a box ridge with an external channel in accordance with the present invention.

All these arrangements are secured by means of fixing bolts 85. FIG. 9 illustrates a reinforced external bulb channel roof ridge 90 where the reinforcement is in the form of vertical 'T' frames 91 horizontally connected with steel rods. FIG. 10 illustrates an external bulb channel ridge 100 in the form of a box ridge for use on locations of extreme exposure. This roof ridge is similar to that of FIG. 5*a*.

All the roof ridge 6 devices are secured by bolting down to a roof construction. An addition may be added in the form of an absorbent rubber mounting washer which gives the roof ridge 6 an ability to move slightly on loading and this reduces the force on the harness wearer. Also a continuous hole through the aperture of each of the ridge sections 6 can be provided through which an additional safety wire can be passed and put under tension at each extreme end by way of a threaded bolt connection.

Figure 11A:
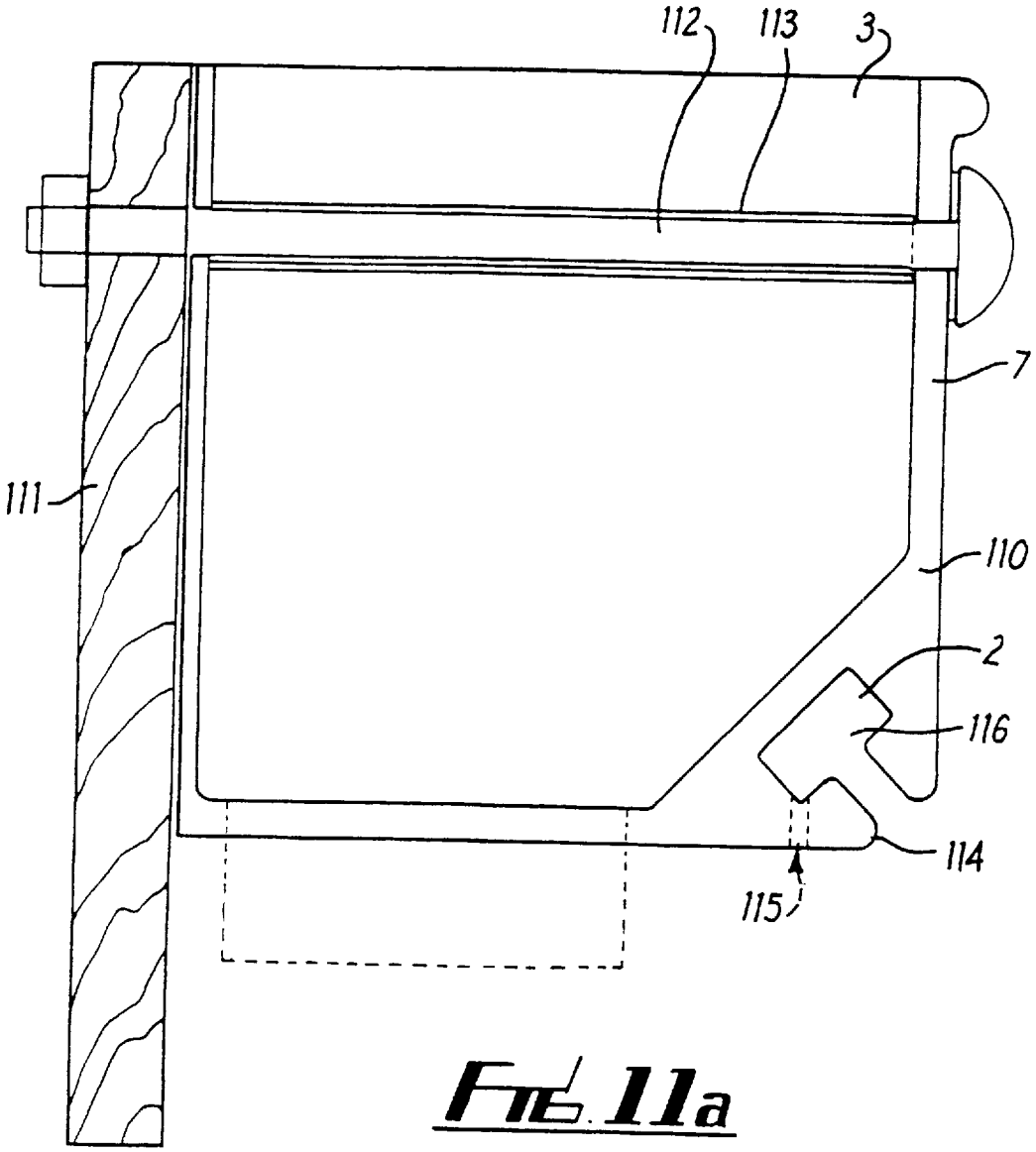
FIGS. 11*a* and *b* are gutter sections in accordance with the present invention.
Figure 11B:
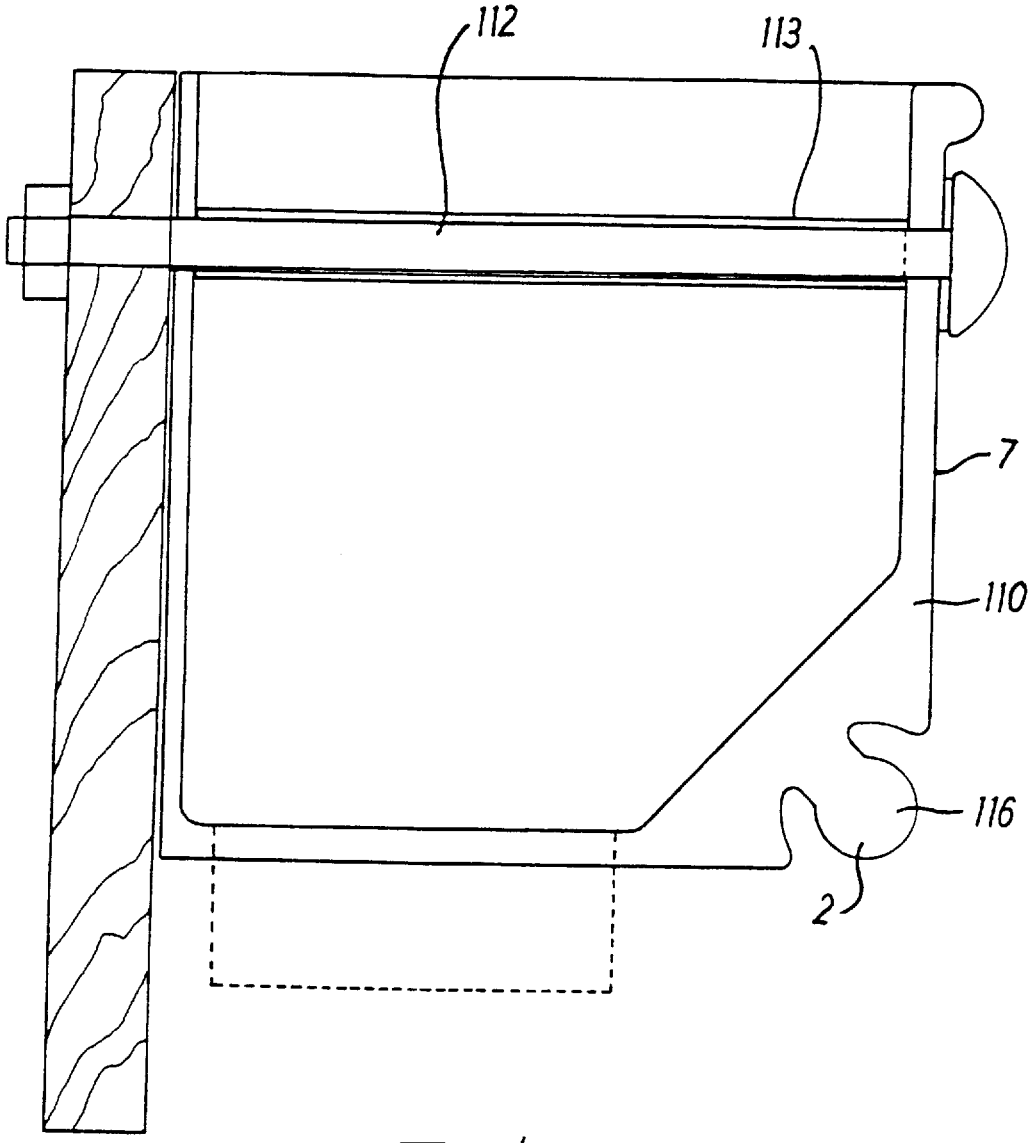

Referring to FIG. 11, the building component 3 having a channel 1 for a safety device can be in the form of a rainwater gutter 7, section 110. The gutter section 110 is fastened to the facing and roof construction 111 by means of a fixing bolt 112 through a spacer tube 113. The channel 116 may be an external or internal channel and is disposed of the lower outer corner 114 of the gutter section 110. If the channel 116 is internal, a drain hole 115 is provided to ensure that the channel 116 does not become waterlogged. The channel 116 is formed of extruded aluminium or moulded glassfibre reinforced cement, mild steel, or pvc and by passes vertical downpipes and thus provides a continuous anchor point. The gutter section 110 is securely bolted to the roof structure 111 behind the facing or eaves board.

The building component 3 having a channel 2 for a safety device may also be in the form of an undereaves ventilation soffit 120 which may include an insect mesh 121. Where the channel is an internal longitudinal channel 123 (as seen in FIG. 12*b* ) a shaped safety track is bolted 124 to cleats 128 each side of a rafter 125. The safety track is in the form of a housing comprising two longitudinal web members 150 which are held apart by a flange member 151 which serves to space the web members 150 apart. A longitudinal channel 123 is thus formed between the web members 150.

Each web member has an external projecting edge 126 to receive a soffit board lining 127 on its outer face and an internal projecting portion 152 on its inner face.

The internal projecting portions 152 form the sides of a continuous longitudinal opening 129 to the longitudinal channel 123.

The cleats are disposed each side of a rafter 125 and through bolted.

In the arrangement where the channel 2 is an external bulb channel 130, as shown in FIG. 12*a*, the safety track is again bolted 131 to cleats 137 each side of a rafter 133 and has a projecting edge 134 to receive a soffit board lining 135.

The safety track is in the form of a housing comprising two longitudinal web members 153 which are held apart by a spacing member 154 which serves to space the web members 153 apart and allow ventilation 136 therethrough.

Each web member has an external projecting edge 134 to receive a soffit board lining 135 on its outer face. The bulb channel 130 is attached beneath the spacing member 154. A traveller 14 with an attachment loop 15 for a safety harness can slide along the bulb channel 130.

Ventilation 136 is provided around the external channel 130.

Finally, the building component 3 may be in the form of a roof tile 140 having a channel 141 running along the lower edge 142 of the tile 140. Such a tile 140 can match an existing manufacturers range of tiles and the channel 141 can extend across a number of tiles 140 which are adjacently disposed. The tiles 140 if in the form of slot tiles, can be secured to a roof by means of an extended button clip 143 bolted 144 to the roof construction. The tiles 140 can be located next to the ridge or at any other position to suit access requirements.

In use the building components 3 have an internal or external channel 2 along which a traveller 4 may run. A person requiring access to a roof area can secure his safety harness to the attachment means 5 of the traveller 4. The person can then move freely about a roof area and the harness will pull the traveller 4 along the channel. The traveller 4 and channel are designed to support loads sufficient to support a falling person.

An internal channel 2 can be surrounded by a reservoir 200 as seen in FIG. 5*b* in order to prevent ice forming in the channel in cold weather. The reservoir can be heated by means of a trace wire electric current and may contain a substance such as oil.

Modifications and improvements can be incorporated without departing from the scope of the invention.

We claim:

1. A safety device for a roof eave supported under roof rafters, comprising an elongated body including two longitudinal web members which are held apart from each other by a flange member, said flange member being provided with ventilation means to allow air to circulate through said flange member, each said web member having an inner face and an outer face, the outer face of each said web member having projecting edges being adapted to receive a soffit board which is supported on the roof eave, said web members forming a safety track beneath the flange member, said safety device having means for attaching the safety device to the roof rafters, a traveller being slidably attached on the track, and said traveller having a safety harness attachment means for securing a user.

2. A safety device as claimed in claim 1, wherein said safety device has first and second ends and wherein said track extends from said first end to said second end of said safety device.

3. A safety device as claimed in claim 1, wherein a mesh extends across said passages to provide a barrier for insects.

4. A safety device as claimed in claim 1 wherein said inner face of each web member has an integral projecting portion remote from said flange member, said internal projecting portions being aligned to form a recess, said recess forming said safety track.

5. A safety device as claimed in claim 1, wherein said track is in the form of a housing having a continuous longitudinal opening, said traveller being longitudinally slidable within said housing and having an arm extending through said opening forming said safety harness attachment means, said traveller having a upper portion being trapped within the housing.

6. A safety device as claimed in claim 1, wherein said safety device comprises a longitudinal bulb section projecting beneath said flange member and spaced from said web members, said bulb section forming said safety track.

* * * * *